US005338029A

United States Patent [19]

Falzone

[11] Patent Number: 5,338,029

[45] Date of Patent: Aug. 16, 1994

[54] GOLF CLUB OF THE IRON TYPE

[76] Inventor: Peter A. Falzone, 1101 Willowood Cir., Gulf Breeze, Fla. 32561

[21] Appl. No.: 76,774

[22] Filed: Jun. 15, 1993

[51] Int. Cl.[5] ..... A63B 53/02

[52] U.S. Cl. ..... 273/80.2; 273/167 G; 273/80 C

[58] Field of Search ..... 273/167 R–77 A, 273/77 R, 162 R, 164.1, 193 R, 194 R, 80.1, 80.2, 79, 187.4, 186.2, 80 C; D21/214–220

[56] References Cited

U.S. PATENT DOCUMENTS

| | | | |
|---|---|---|---|
| 1,657,972 | 1/1928 | Rowe | 273/80.1 |
| 2,478,468 | 8/1949 | Drake | 273/167 G |
| 2,683,036 | 7/1954 | Klein | 273/167 G |
| 3,989,257 | 11/1976 | Barr | 273/167 G X |
| 4,702,477 | 10/1987 | Solomon | 273/80 C |
| 5,199,707 | 4/1993 | Knox | 273/167 F X |

FOREIGN PATENT DOCUMENTS

| | | | |
|---|---|---|---|
| 2611510 | 9/1988 | France | 273/77 A |
| 15597 | of 1904 | United Kingdom | 273/80 C |

*Primary Examiner*—Vincent Millin
*Assistant Examiner*—Sebastiano Passaniti

[57] ABSTRACT

A golf club of the iron type designed to prevent shanking of the ball. The club comprises a club head having an upper edge, a sole, a heel, and a toe. The club head further comprises a rear surface and a forward striking face, each extending from heel to toe. The club's shaft extends along an axis outwardly and downwardly to a mounting device for attaching the shaft to the club head. The mounting device comprises a member which, in the vicinity of the upper edge, is spaced from and to the rear of the upper edge, and extends therefrom downwardly and forwardly to attach to the rear surface. Preferably, the location of attachment is on a line spaced the same distance from the sole as the center of mass of the club head, and ideally it is directly to the rear of the center of mass.

3 Claims, 1 Drawing Sheet

GOLF CLUB OF THE IRON TYPE

BACKGROUND OF THE INVENTION

The invention relates to a golf club of the iron type, and more particularly to such a club which is less likely to produce a shanked shot than conventional irons.

Golf clubs are made in three distinct types or categories. Among these is the putter, designed to roll the ball on the ground without causing the ball to take flight. The remaining types are designed to propel the ball through the air with various trajectories, and include the several woods (commonly now made with metal heads shaped like conventional woods), and the irons (1–9 irons, pitching wedge, and sand wedge).

The head of an iron comprises a heel and a toe, the former being nearest the golfer when the club is in use and the latter being furthest from the golfer, with the striking face between the heel and toe. The shaft of the club is ordinarily mounted at or attached to the heel of the club, and is accordingly mounted eccentrically with respect to the striking face.

When the iron is swung correctly, contact with the ball is made with a particular portion of the striking face (commonly referred to as "the sweet spot") and the desired trajectory is produced. However, if contact between the ball and the iron is with the heel at the attachment of the shaft, the resulting trajectory of the ball is unpredictable. This unfortunate event is referred to as "shanking" the ball.

These and other difficulties with conventional prior art irons are substantially reduced by the present invention, which provides novel irons having several advantages as noted below.

SUMMARY OF THE INVENTION

According to a primary aspect of the invention, there is provided a golf club of the iron type, comprising a club head having an upper surface, a sole, a heel and a toe, a rear surface and a forward striking face. Each of the rear surface and the striking face extends from the heel to the toe. The striking face lies in a first plane forming an obtuse angle with a horizontal plane. The club head has a center of mass spaced from the sole. The club further comprises an elongated shaft having an axis extending downwardly and outwardly from an upper end thereof to a lower end thereof. Mounting means are provided for mounting the lower end of the shaft on the rear face at a location between the heel and toe and below the upper edge and above the sole with the axis lying in a vertical plane forming an obtuse angle with the first plane. The mounting means comprises a member spaced from and to the rear of the upper edge, and extends downwardly and forwardly to the noted location.

According to another aspect of the invention, the location is directly to the rear of the center of mass of the club head.

According to another aspect of the invention, the location is on a line spaced the same distance from the sole as the center of mass.

Other aspects will in part appear hereinafter and will in part be apparent from the following detailed description taken together with the accompanying drawing, wherein:

DETAILED DESCRIPTION OF THE PREFERRED EMBODIMENT

Figure 1:
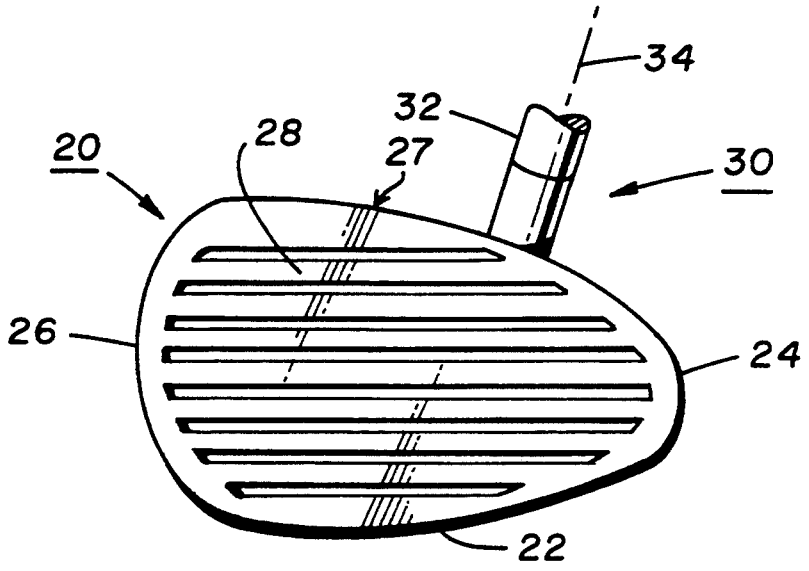
FIG. 1 is a front elevation of the the preferred embodiment.

The iron is illustrated and claimed at address, that is, in the position that a golfer would hold the club just prior to beginning the back swing, with the shaft in a vertical plane. With reference to FIG. 1, the iron comprises club head 20 having sole 22, heel 24, toe 26, and upper edge 27. Forward striking face 28 extends from heel 24 to 26, and lies in a first plane forming an obtuse angle with a horizontal plane as viewed from the front of the club. Club head 20 has a center of mass spaced upwardly from sole 22.

The club further comprises elongated shaft 30, only the lower portion or end 32 of which is illustrated. The non-illustrated upper portion of shaft 30 may have the customary grip for the golfer's hands, if desired. Shaft 30 extends downwardly and outwardly from the golfer along axis 34 to lower end 32.

Figure 2:
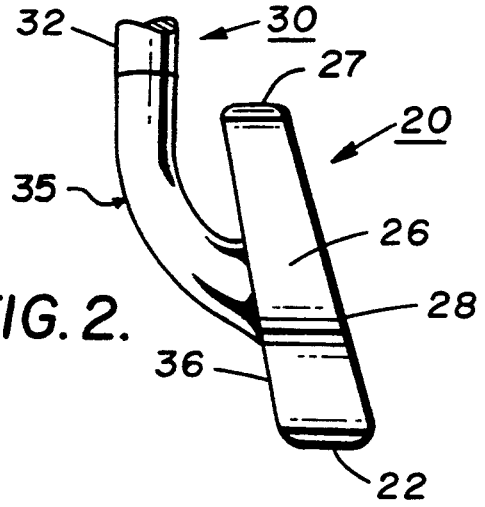
FIG. 2 is a side elevation of the FIG. 1 embodiment.
Figure 3:
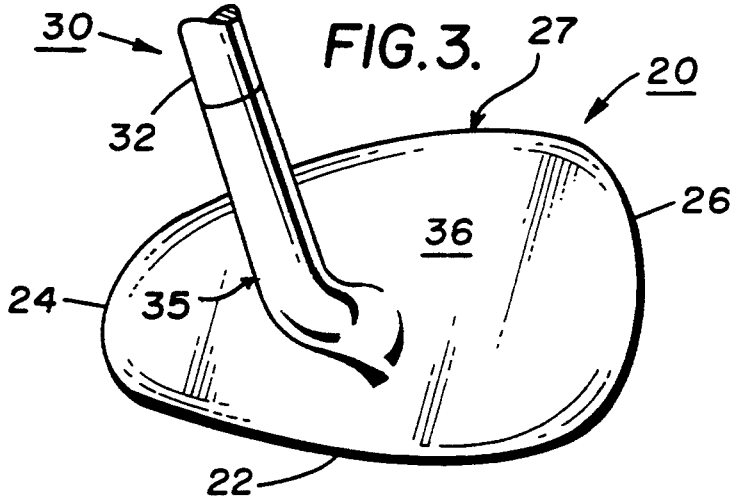
FIG. 3 is a rear elevation of the FIG. 1 embodiment.

According to the invention, mounting means are provided for mounting the lower end of lower portion 32 on rear face 36 (FIGS. 2 and 3) at a location between heel 24 and toe 26, below upper edge 27 and above sole 22, with axis 34 lying in a vertical plane forming an obtuse angle as viewed from striking face 28 with the first plane in which striking face 28 lies. The loft of the club face is determined by the obtuse angle. The mounting means is illustrated as a separate member 35 attached to lower end 32, but may be integral with shaft 30, or club head 20, if desired. As best illustrated in FIG. 2, member 35 in the vicinity of upper edge 27 is spaced from and to the rear of upper edge 27, and extends therefrom downwardly and forwardly to the location of attachment to rear surface 36. Provision of the space between member 35 and upper edge 27 provides an additional amount of prevention of contact between shaft 30 and the golf ball.

Preferably, the location of attachment of member 35 to rear surface 36 is on a line spaced the same distance from sole 22 as is the center of mass of club head 20, and ideally is directly behind the center of mass.

The iron as thus described substantially eliminates the possibility of shanking the ball. Further, moving the point of attachment away from heel 24 substantially reduces the probability of inadvertent slicing (causing the ball to curve to the right).

I claim:

1. A golf club of the iron type designed to prevent shanking of a golf ball, said club comprising:

(a) an iron type club head having an upper edge, a sole, a heel and a toe, said club head having a rear face and a forward striking face, each of said rear and said forward faces extending from said heel to said toe, said striking face lying in a first plane forming an obtuse angle with a horizontal plane, said club head having a center of mass spaced from said sole;

(b) an elongated shaft having an axis extending from an upper end thereof downwardly and outwardly to a lower end thereof; and (c) mounting means for mounting said lower end of said shaft on said rear face at a location between said heel and said toe and below said upper edge and above said sole with said axis lying in a vertical plane forming an obtuse angle with said first plane, said mounting means comprising a member spaced from and to the rear of said upper edge, said member extending from said lower end of said shaft downwardly and forwardly to said location.

2. The golf club defined in claim 1, wherein said location is directly to the rear of said center of mass.

3. The golf club defined in claim 1, wherein said location is on a line spaced the same distance from said sole as said center of mass.

* * * * *